US006276026B1

(12) United States Patent
Wille

(10) Patent No.: US 6,276,026 B1
(45) Date of Patent: Aug. 21, 2001

(54) AIRCRAFT HINGE

(75) Inventor: Robert Henry Wille, St. Charles, MO (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 08/814,497

(22) Filed: Mar. 10, 1997

(51) Int. Cl.[7] ..... E05D 11/00

(52) U.S. Cl. ..... 16/250; 16/251; 244/129.5; 244/130; 244/131; 277/637; 277/652

(58) Field of Search ..... 16/250, 251; 49/383, 49/398; 244/129.3, 129.5, 130, 131; 277/920, 921, 637, 652

(56) References Cited

U.S. PATENT DOCUMENTS

| | | | | |
|---|---|---|---|---|
| 1,901,994 | * | 3/1933 | Soss | 16/250 |
| 2,151,240 | * | 3/1939 | Soss | 16/251 |
| 2,368,702 | * | 2/1945 | Bourne | 244/130 |
| 3,075,234 | * | 1/1963 | Speakman | 16/250 |
| 4,709,121 | * | 11/1987 | Shores | 174/35 R |
| 4,796,330 | * | 1/1989 | Ziegler | 16/251 |
| 5,028,739 | * | 7/1991 | Keyser et al. | 174/35 GC |
| 5,106,037 | * | 4/1992 | Sherrill | 244/132 |
| 5,222,699 | | 6/1993 | Albach et al. . | |
| 5,385,774 | * | 1/1995 | Cramer et al. | 428/247 |
| 5,794,893 | * | 8/1998 | Diller et al. | 246/213 |
| 6,048,581 | * | 4/2000 | Waldrop, III | 427/412 |

* cited by examiner

*Primary Examiner*—Anthony Knight
*Assistant Examiner*—Alison K. Pickard
(74) *Attorney, Agent, or Firm*—Harness Dickey & Pierce P.L.C.

(57) ABSTRACT

A hinge (20) an an aircraft (24) has a first plurality of rigid tangs (22) attached to the aircraft (24). A second plurality of rigid tangs (26) are attached to a door (28) and a flexible cover (34) has a cover tang (44). A hinge pin (32) runs inside the first plurality of rigid tangs (22), the second plurality of rigid tangs (26) and the cover tang (44).

13 Claims, 2 Drawing Sheets

FIG 4
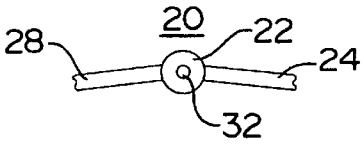
FIG 5
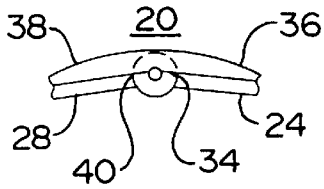
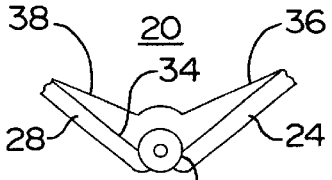
FIG 6
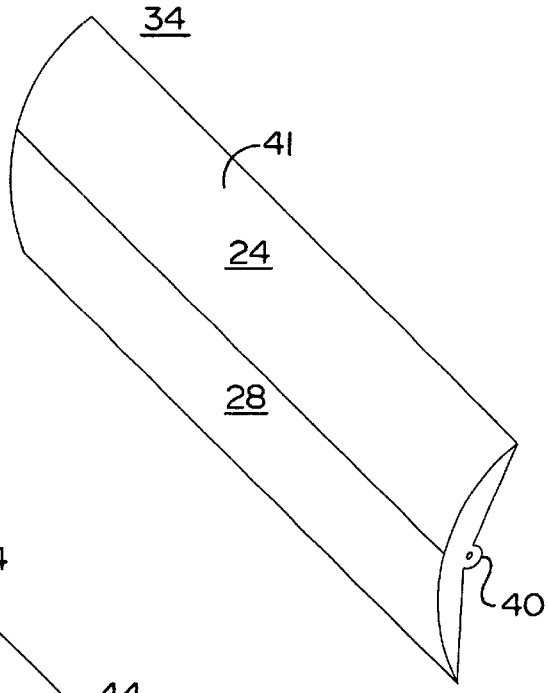
FIG 7
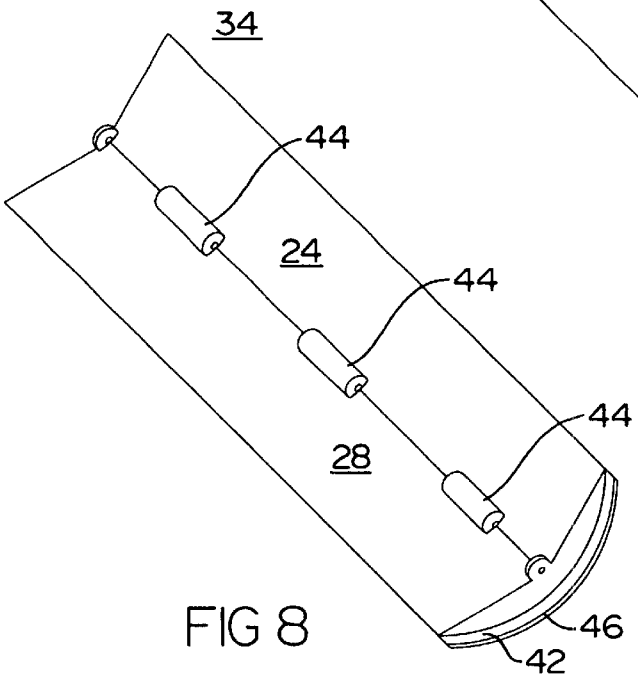
FIG 8

AIRCRAFT HINGE

FIELD OF THE INVENTION

The present invention relates to hinges generally and more particularly to an aircraft hinge and cover.

BACKGROUND OF THE INVENTION

Modern aircraft have avionics bay access doors or equipment access doors with piano type hinges. These access doors allow maintenance personnel to repair equipment and avionics stored behind these doors. Unfortunately, piano type hinges stick out of the moldline of the aircraft slightly and create drag. In addition, the piano hinges allow vapors, dirt and liquids to seep into the compartments. These contaminants can reduce the lifetime of the avionics and equipment.

Thus there exists a need for an aircraft hinge that does not create drag and does not allow contaminants into the equipment and avionics bays.

SUMMARY OF THE INVENTION

A hinge on an aircraft that overcomes these and other problems has a first plurality of rigid tangs attached to the aircraft. A second plurality of rigid tangs are attached to a door and a flexible cover has a cover tang. A hinge pin runs inside the first plurality of rigid tangs, the second plurality of rigid tangs and the cover tang.

BRIEF DESCRIPTION OF THE DRAWINGS

FIG. 4 is an end view of part of an aircraft hinge;

FIG. 5 is end view of an aircraft hinge;

FIG. 6 is an end view of the aircraft hinge of FIG. 5 in an open position;

FIG. 7 is a top view of a flexible cover of the aircraft hinge; and

FIG. 8 is a bottom view of the flexible cover of FIG. 7.

DETAILED DESCRIPTION OF THE DRAWINGS

Figure 1:
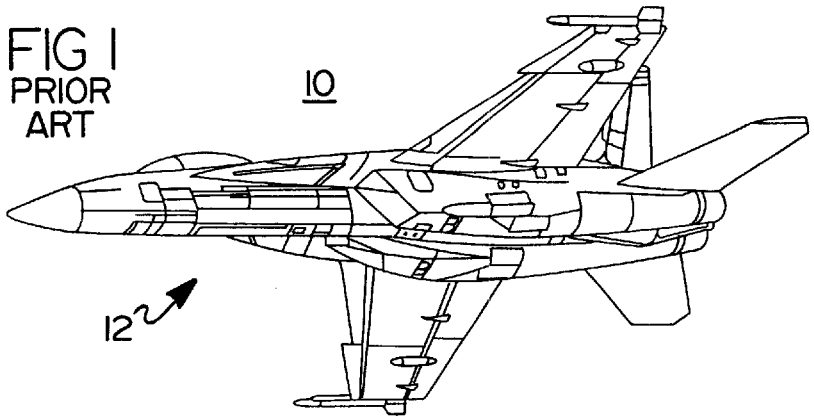
FIG 1 PRIOR ART
FIG. 1 is a bottom left perspective view of an aircraft.
Figure 2:
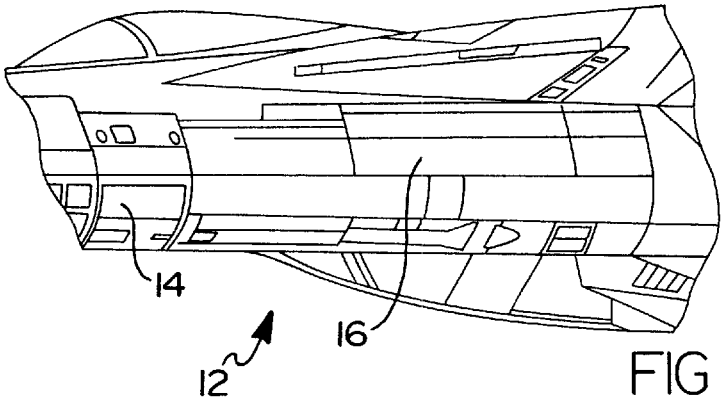
FIG 2 PRIOR ART
FIG. 2 is an expanded portion of the aircraft of FIG. 1.

A bottom perspective view of a modern aircraft 10 is shown in FIG. 1. Avionics bay access door 14 and equipment access doors 16 (see FIG. 2) are located on the underside of the fuselage 12 of the aircraft 10. These access doors 14, 16 are generally secured to the aircraft 10 using piano type hinges.

Figure 3:
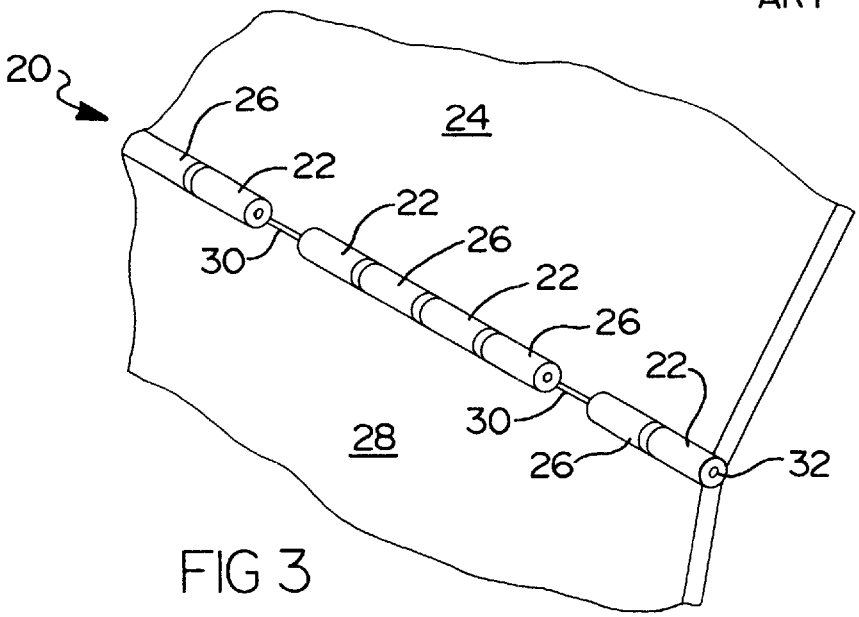
FIG. 3 is a perspective view of a piano hinge.

FIG. 3 shows a portion of an aircraft hinge 20 according to the invention. A first plurality of rigid tangs 22 are attached to the aircraft 24. A second plurality of rigid tangs 26 are attached to a door 28. Several areas 30 are missing tangs 26 and 30 and the use reason for these missing tangs 26, 30 will become apparent shortly. In one embodiment, the first plurality of rigid tangs 22 and the second plurality of tangs 26 are made of metal. When the aircraft hinge 20 is assembled a hinge pin 32 is inserted through the holes in the plurality of tangs 22, 26.

FIG. 4 shows an end view of a portion of the aircraft hinge 20. A flexible hinge cover 34 is placed over the plurality of tangs 22, 26 (See FIG. 5) to complete the aircraft hinge 20. The hinge cover 34 hermetically seals the hinge, preventing contaminants from entering through the hinge. In addition, the hinge cover 34 forms a smooth curvilinear surface that reduces the aerodynamic drag due to the hinge. The hinge cover 34 is made from an elastomeric material and includes a pair of flanges 36, 38 that meet along the centerline of the cover 34. In one embodiment, the hinge cover 34 has an end tab 40 that covers the end tang. In one embodiment, the flanges 36, 38 are attached with adhesive to the door 28 and to the aircraft 24, respectively. In another embodiment, mechanical attachment mechanisms are used to secure the flanges 36, 38 to the door 28 and the aircraft 24, such as screws or clasps. FIG. 6 shows the aircraft hinge 20 in an open position. The flexible cover 34 conforms to the hinge shape in the open position.

FIG. 7 shows a top perspective view of the hinge cover 34. The cover 34 has an exterior surface 41 that in one embodiment is covered with an elastic conductive material 42 (see FIG. 8). The elastic conductive material 42 in one embodiment is a metalized knit fabric. The elastic conductive material 42 forms an EMI (electromagnetic interference) shield, that protects the avionics from interference.

FIG. 8 also show a plurality of cover tangs 44 disposed at the centerline of the cover 34. The cover tangs (third plurality of tangs) 44 are inserted at the areas 30 of FIG. 3. These cover tangs 44 help secure the cover 34 to the aircraft 24 when the hinge pin 32 is inserted 44.

In another embodiment, an environmental cover (environmental elastomeric coating) 46 is placed over the elastic conductive material 42. The environmental cover 46 protects the hinge cover 34 from the corrosive effects of a plurality of chemical solvents, including hydraulic oil, jet fuel and kerosene. The environmental cover in one embodiment is made from fluorosillicones, fluoroelastamers, silicones, thermoplastic elastomer, urethanes or other viable elastic materials.

Thus there has been describe an aircraft hinge that prevents contaminants from seeping into avionics bays. In addition, the hinge cover prevents EMI from entering through the hinge. While the invention has been described in conjunction with specific embodiments thereof, it is evident that many alterations, modifications, and variations will be apparent to those skilled in the art in light of the foregoing description. Accordingly, it is intended for the foregoing description to embrace all such alterations, modifications, and variations in the appended claims.

What is claimed is:

1. A hinge providing an aerodynamic seal at an external interface of a moving component and a stationary component on an aircraft, comprising:

a first plurality of rigid tangs attached to the aircraft;

a second plurality of rigid tangs attached to a door;

an elastomeric, flexible cover having an aerodynamic shape adapted to be used over external surfaces of said components of said aircraft to provide an aerodynamically efficient transition between said external surfaces, said flexible cover having a cover tang;

a hinge pin inside the first plurality of rigid tangs, the second plurality of rigid tangs and the cover tang; and said flexible cover permitting one of said components to be opened to project from a moldline of said aircraft while said hinge provides a smooth, aerodynamic transition between said external surfaces.

2. The hinge of claim 1, wherein the flexible cover has a pair of flanges formed in the elastomeric material.

3. The hinge of claim 2, wherein the flexible cover has an exterior surface and the exterior surface is covered with a conductive material.

4. The hinge of claim 3, wherein the conductive material is covered with an environmental elastomeric coating.

5. The hinge of claim 4, wherein the environmental coating is impervious to a plurality of chemical solvents.

6. The hinge of claim 1, wherein the flexible cover has a third plurality of tangs.

7. The hinge of claim 1, further including an adhesive between the flexible cover and the door.

8. The hinge of claim 1, further including an adhesive between a portion of the flexible cover and the aircraft.

9. A hinge cover providing an aerodynamic seal at an external interface of two hinge components pivotally securing a moveable panel to a fixed portion of an aircraft fuselage, said hinge cover comprising:

a tang;

an elastomeric panel forming a pair of flanges adapted to provide an aerodynamically shaped covering over said two hinge components, the tang connected at a centerline of the elastomeric panel and the pair of flanges meeting along the centerline of the elastomer panel; and an elastic conductive material covering an exterior surface of the elastomeric panel.

10. The hinge cover of claim 9, further including an environmental cover over the elastic conductive material.

11. The hinge cover of claim 9, Wherein the tang is formed of an elastomeric material.

12. The hinge cover of claim 9, Wherein the elastic conductive material is a metalized knit fabric.

13. The hinge cover of claim 9, further including a plurality of other tangs formed along the centerline of the elastomeric panel.

* * * * *

UNITED STATES PATENT AND TRADEMARK OFFICE

CERTIFICATE OF CORRECTION

PATENT NO. : 6,276,026 B1
DATED : August 21, 2001
INVENTOR(S) : Wille

It is certified that error appears in the above-identified patent and that said Letters Patent is hereby corrected as shown below:

Title page,
ABSTRACT,
Line 2, "an an aircraft" should read -- on an aircraft --.

Column 1,
Line 37, after "is" insert -- an --.
Line 56, delete "use".

Column 2,
Line 21, "show" should read -- shows --.
Lines 22-23, delete "third plurality of tangs".
Line 25, after "inserted" insert -- through each of the tangs 24, 26 and --.
Line 31, after "cover" insert -- 46 --.
Line 32, "fluorosillicones" should read -- fluorosilicones --; and "fluoroelastamers" should read -- fluoroelastomers --.

Column 4,
Lines 10 and 12, "Wherein" should read -- wherein --.

Signed and Sealed this

Eleventh Day of June, 2002

*Attest:*

*Attesting Officer*

JAMES E. ROGAN
*Director of the United States Patent and Trademark Office*